United States Patent [19]

Irvine

[11] Patent Number: 5,072,828

[45] Date of Patent: Dec. 17, 1991

[54] KNOCK-DOWN ROADSIDE TRASH PROTECTOR

[76] Inventor: Earl L. Irvine, 11071 E. Terry St., Bonita Springs, Fla. 33923

[21] Appl. No.: 176,661

[22] Filed: Apr. 1, 1988

[51] Int. Cl.[5] ..... B65D 6/08

[52] U.S. Cl. ..... 220/4.33; 220/335; 220/493; 220/958

[58] Field of Search ..... 220/1.5, 1 T, 19, 4 F, 220/18, 4.33, 493; 217/43

[56] References Cited

U.S. PATENT DOCUMENTS

| | | | |
|---|---|---|---|
| 414,622 | 11/1889 | Willits | 217/43 |
| 446,579 | 2/1891 | Brown | 217/43 |
| 906,891 | 12/1908 | Johnston | 217/43 |
| 1,840,561 | 1/1932 | Miller | 220/19 |
| 1,890,983 | 12/1932 | Griffith | 220/19 X |
| 2,823,821 | 2/1958 | Frater et al. | 220/4 F |
| 3,883,026 | 5/1975 | Selz | 220/1.5 |
| 3,935,958 | 2/1976 | Frangos | 220/19 |
| 4,798,019 | 1/1989 | Sury et al. | 135/901 X |

FOREIGN PATENT DOCUMENTS

| | | | |
|---|---|---|---|
| 1140957 | 8/1957 | France | 220/19 |
| 2274510 | 1/1976 | France | 220/4 F |
| 2447324 | 9/1980 | France | 220/4 F |

*Primary Examiner*—Stephen Marcus
*Attorney, Agent, or Firm*—Merrill N. Johnson

[57] ABSTRACT

A readily assembled container for holding a plurality of filled trash bags awaiting collection. The container consists of six rectangular panels each having a polyvinyl chloride (PVC) pipe frame and a section of galvanized wire hardware cloth attached to the inside of the frame. Five of the six panels are designed and sized to be bolted together to form the sides and bottom of a knock-down trash container. The sixth panel is sized to form a cover connected to the container by a pair of hinges. The container is supported above the ground by four legs of variable length also made of PVC pipe which fit into sockets at the four bottom corners of the assembled container.

2 Claims, 2 Drawing Sheets

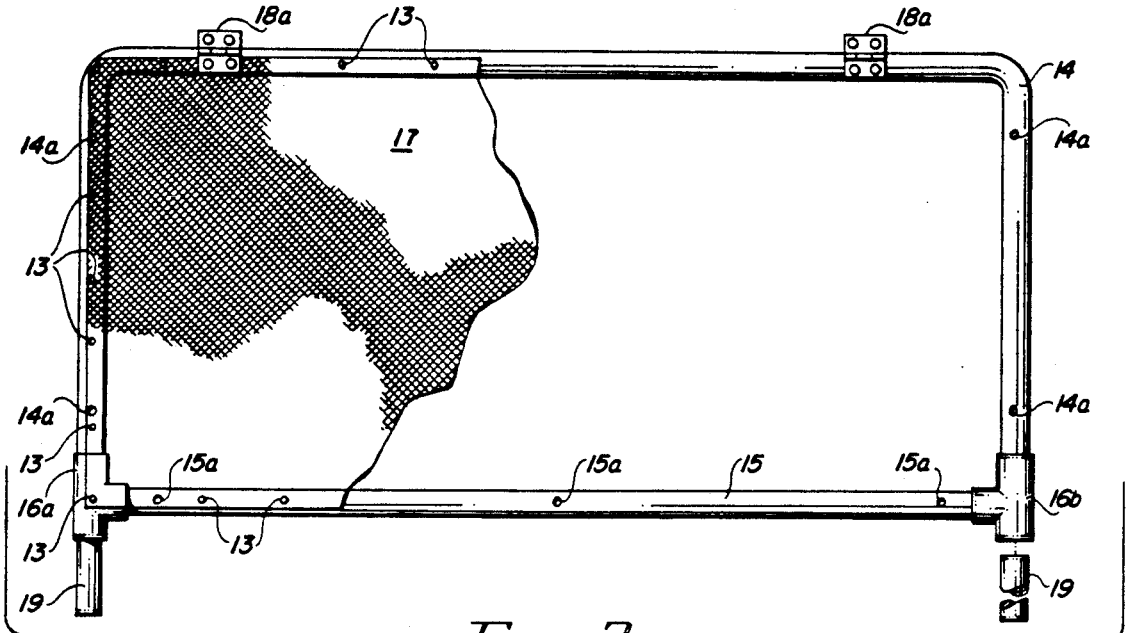
FIG. 3
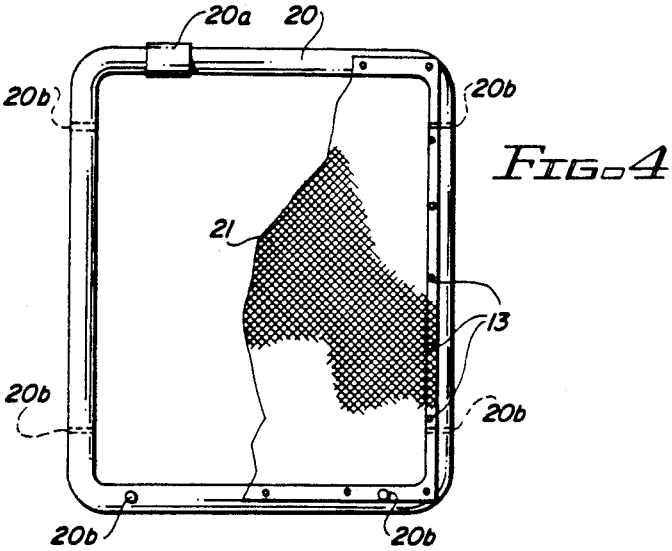
FIG. 4
FIG. 5
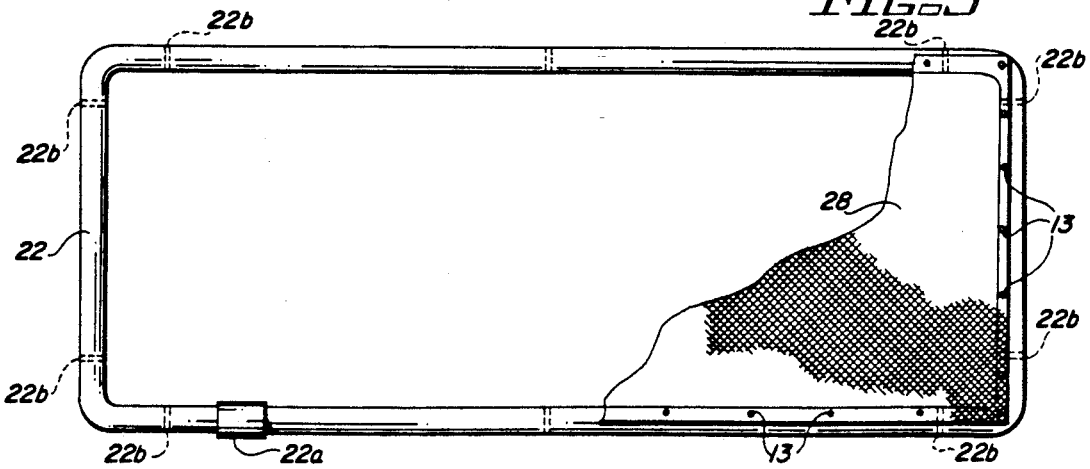

KNOCK-DOWN ROADSIDE TRASH PROTECTOR

BACKGROUND AND SUMMARY OF THE INVENTION

The invention lies in the field of containers for trash and particularly containers for filled plastic bags of trash designated for collection by municipal or other garbage trucks.

Metal and plastic garbage or trash containers are well known and serve a useful purpose. Also known are wheeled containers conventionally molded of plastic materials and designed to hold four to six filled plastic bags of trash. These containers are normally kept near the back door of a family residence until the night before the garbage collection truck is due to make its pick-up when the container is wheeled out to the street or roadside to be emptied the next day.

The other conventional procedure is to have two or three 40 gallon metal or plastic cans near the back door which by the night before the trash is to be picked up are usually filled with bags of trash. Then these several cans must be put out on the street or roadside to await the visit of the municipal garbage truck. In the meantime, the wheeled container or the trash cans are subject to being overturned by dogs, other animals, vandals or the wind and weather.

Additionally, before the wheeled container or cans are moved to the roadside, the back door area is subject to unpleasant odors eminating from the containers and the attraction of flies, other insects and animals to the garbage-filled containers at the rear entrance to the home.

I have invented a readily assembled container designed to be stationed along the roadside for holding a plurality of filled trash bags awaiting collection. My container can be shipped knocked-down in a single package and then easily assembled by a homeowner.

My invention overcomes many of the deficiencies of garbage cans and wheeled containers. My unique trash container has the following advantages:

As a bag of trash is filled in the house, it can be immediately brought to the roadside container and away from the family living area.

The trash to be picked up is always at the roadside waiting pick up even when the family is away from the home.

By providing legs of variable height, my container provides a much more stable base than trash cans or wheeled containers.

Because of its openness, my container is easily cleaned by just turning the hose on it.

In its preferred form my trash protector comprises six generally rectangular panels each having a rectangular frame made of PVC hollow pipe with a section of galvanized wire hardware cloth firmly attached to the inside of the PVC pipe frame.

Five of the six panels are designed and sized to be bolted together to form the two sides, two ends and bottom of the easily disassembled trash container.

The sixth panel is dimensioned to form the cover of the container and is preferably mounted on the container by a pair of hinges.

The container is supported with its bottom above the level of the ground by four PVC pipe legs fitted into the four bottom corners of the assembled container.

BRIEF DESCRIPTION OF THE DRAWINGS

The drawings illustrate a preferred embodiment of my knock-down roadside trash protector in which:

FIG. 3 is an elevational view of the back of the trash protector shown in FIG. 1 with the hinges which are to be attached to the cover shown in FIG. 2;

FIG. 4 is an elevational view of one of the two end panels of the trash protector shown in FIG. 1; and FIG. 5 is a plan view taken from above of the bottom panel of the trash container shown in FIG. 1.

DETAILED DESCRIPTION OF A PREFERRED EMBODIMENT

Figure 1:
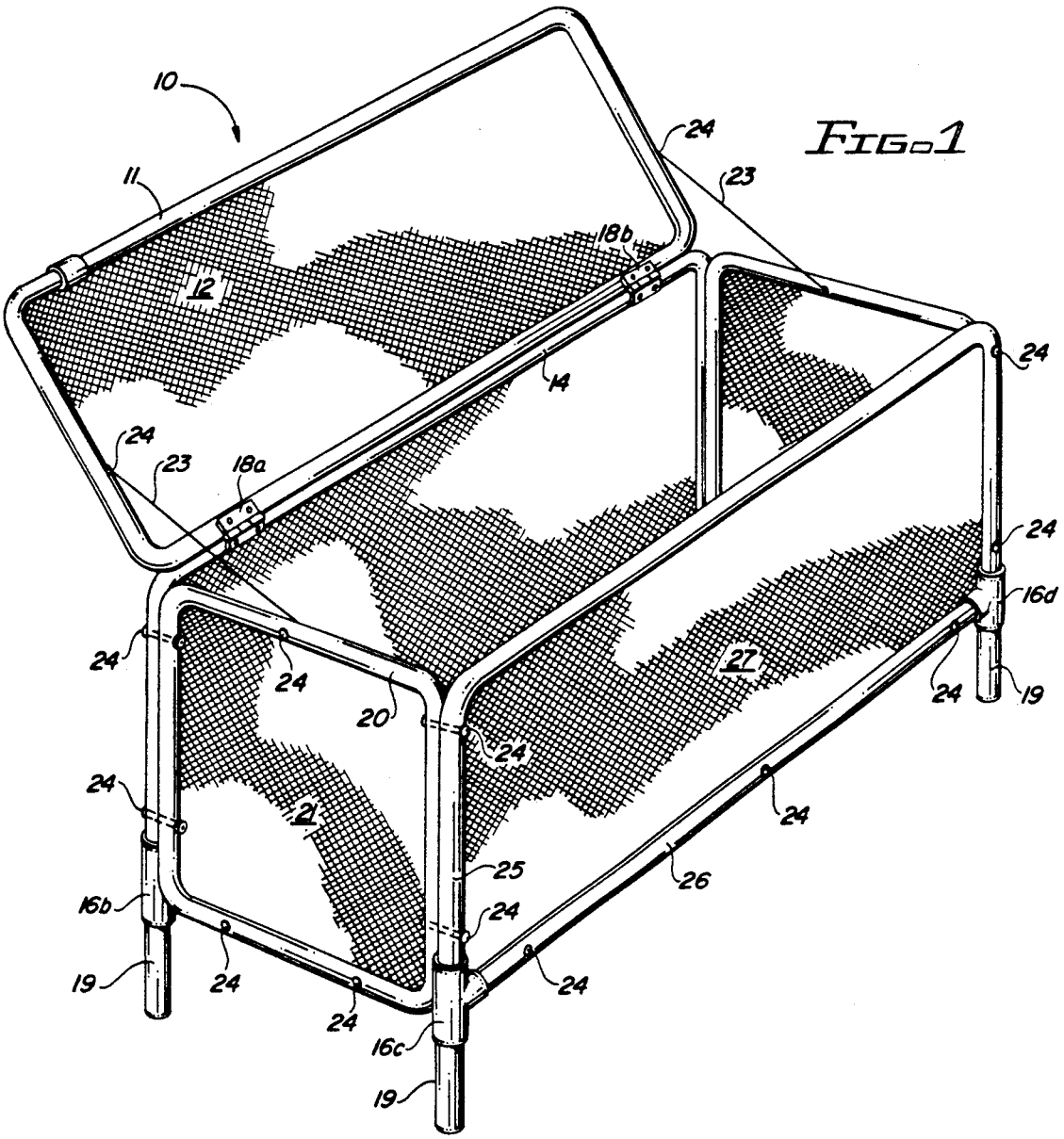
FIG. 1 is a perspective view of my assembled trash protector.

Referring to FIG. 1 of the drawings, a preferred embodiment of my assembled roadside trash protector 10 is shown with its cover opened to receive filled trash bags.

Trash protector 10 is assembled from six rectangular panels each consisting of a polyvinyl chloride (PVC) pipe frame and a section of galvanized wire cloth attached to the frame. The cover of the protector is shown in FIG. 2 and consists of a rectangular frame 11 of PVC pipe whose ends are joined together by coupling 11*a*.

Figure 2:
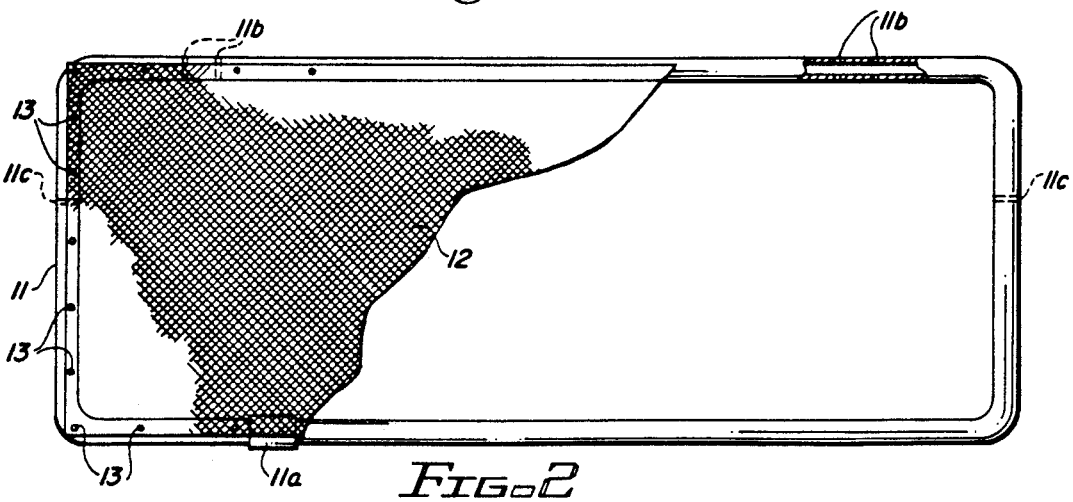
FIG. 2 is a plan view taken from above of the cover of the trash protector shown in FIG. 1.

In order to attach the cover to the back panel of the protector 10, two pairs of holes 11*b* are drilled in pipe 11 as shown in FIG. 2, and to attach one end of each of two retaining cables 23 to cover two additional holes 11*c* are drilled into pipe 11.

A rectangle of galvanized wire cloth 12 is attached to pipe 11 by means of a plurality of self-tapping screws 13.

The back panel of protector 10 is shown in FIG. 3 and consists of a C-shaped length of PVC pipe 14 whose opposite ends are fitted into two PVC T-joints 16 and 16*b* and a length of PVC pipe 15 whose opposite ends also fit into T-joints 16*a* and 16*b* as shown in FIG. 3.

A rectangle of galvanized wire cloth 17 is attached to pipes 14 and 15 by a plurality of self-tapping screws 13. A pair of hinges 18 and 18*b* are attached to pipe 14 and also to frame 11 of the protector's cover as shown in FIGS. 1 and 2. Pipe 14 also includes four drilled holes 14*a* to receive bolts 24 which connect the back panel to the two ends of the protector as shown in FIG. 1.

The left end of protector 10 is shown in FIG. 4 and consists of frame 20 of PVC pipe whose ends are joined by PVC coupling 20*a*. Frame 20 includes six drilled holes 20*b* spaced to receive assembly bolts 24 as shown in FIG. 1. A rectangle of galvanized wire cloth 21 is attached to frame 20 by a plurality of flat-headed self-tapping screws 13.

The bottom of protector 10 is shown in FIG. 5 and consists of rectangular frame 22 of PVC pipe whose ends are joined together PVC coupling 22*a*. Frame 22 includes a plurality of drilled holes 22*b* spaced to receive assembly bolts 24 as shown in FIG. 1. A rectangle of galvanized wire cloth 28 is attached to frame 22 by a plurality of screws 13.

The front panel of protector 10 is constructed generally similarly to the rear panel shown in FIG. 3 and includes C-shaped PVC pipe 25, straight PVC pipe 26, a pair of PVC T-joints 16*c* and 16*d* and wire cloth rectangle 27 as shown in FIG. 1.

Trash protector 10 also includes four lengths of PVC pipe 19 sized to fit into the lower extensions of T-joints 16*a*, 16*b*, 16*c* and 16*d* to serve as the legs which elevate the bottom panel of protector 10 above ground level. Legs 19 can be cut to various lengths to keep protector 10 level despite irregularities in the surface upon which the protectors rests.

The opposite ends of the two retaining cables 23 are secured to frame 11 of the cover and to the frames 20 of the end panels by screws 24 as shown in FIG. 1.

Protector 10 is manufactured as six separate panels, four legs 19, two retaining cables 23 and a plurality of assembly bolts 24 which can fit into one carton for shipment and storage, but which then be easily assembled by the homeowner.

While I have shown and described a preferred embodiment of my Knock-Down Trash Protector, various changes and modifications in dimensions and arrangements will now be apparent to those skilled in the art. Accordingly, no limitation of my invention is intended by such description and the scope of my invention is set forth only in the appended claims.

I claim:

1. A readily assembled container for holding trash comprising six rectangular panels each consisting of a frame made of hollow pipe and a rectangular section of galvanized wire cloth attached to the frame, five of the rectangular panels being designed and sized to be joined together by a plurality of bolts to form the four sides and bottom of said container, and the sixth panel being designed and sized to form a cover for the container joined to the frame of one of the said panels by a pair of hinges, four hollow T-shaped fittings each of which forms a bottom corner of the frame of two oppositely disposed side panels and which includes a downwardly facing open socket, and four legs for supporting the container designed to fit into the four sockets located at the four bottom corners of the assembled container.

2. A readily assembled container for holding filled trash bags comprising six rectangular panels each consisting of a rectangular frame made of polyvinyl chloride pipe to which is attached a rectangular section of galvanized wire cloth, five of the rectangular panels being designed and sized to be joined together by a plurality of assembly bolts to form the four sides and bottom of said trash container, the assembled container having at each of its four bottom corners a T-shaped fitting which forms the bottom corner of the assembled container and which includes a downwardly projecting hollow socket, the sixth rectangular panel being designed and sized to form a cover which is connected to the frame of one of the side panels of the container by a pair of hinges, and four legs for supporting the container sized to fit into the four hollow sockets at the four bottom corners of the assembled container.

* * * * *